US006964138B2

(12) United States Patent
Carroll et al.

(10) Patent No.: US 6,964,138 B2
(45) Date of Patent: Nov. 15, 2005

(54) WALL PANEL SYSTEM

(75) Inventors: Mark Carroll, Columbus Junction, IA (US); Tom Michel, Iowa City, IA (US); Timothy J. Nichols, Muscatine, IA (US); Martin J. Traver, Wheatland, IA (US); Osama E. Abusada, Iowa City, IA (US); Jason L. Thorn, Muscatine, IA (US); Travis E. Wright, Morning Sun, IA (US)

(73) Assignee: HNI Technologies Inc., Muscatine, IA (US)

( * ) Notice: Subject to any disclaimer, the term of this patent is extended or adjusted under 35 U.S.C. 154(b) by 331 days.

(21) Appl. No.: 10/145,338

(22) Filed: May 14, 2002

(65) Prior Publication Data

US 2003/0213193 A1 Nov. 20, 2003

(51) Int. Cl.[7] ..... E04B 1/38; E04B 1/343

(52) U.S. Cl. ..... 52/239; 52/238.1; 52/242; 52/98; 52/731.5; 52/127.5

(58) Field of Search ..... 52/239, 238.1, 52/242, 241, 731.9, 731.5, 100, 98, 127.5; 160/135, 351, 371, 381

(56) References Cited

U.S. PATENT DOCUMENTS

| | | | | | |
|---|---|---|---|---|---|
| 3,868,804 | A | * | 3/1975 | Tantlinger | 52/98 |
| 4,458,461 | A | * | 7/1984 | Holley | 52/239 |
| 4,463,046 | A | | 7/1984 | Hutchison et al. | |
| 4,586,769 | A | * | 5/1986 | Tengler et al. | 439/594 |
| 4,971,281 | A | | 11/1990 | Steinbeck | |
| 5,743,055 | A | | 4/1998 | Conner et al. | |
| 5,875,596 | A | * | 3/1999 | Muller | 52/239 |
| 5,905,229 | A | * | 5/1999 | McKitrick et al. | 174/48 |
| 5,918,422 | A | * | 7/1999 | Bucher, Jr. | 52/36.5 |
| 6,141,926 | A | * | 11/2000 | Rossiter et al. | 52/239 |
| 6,202,381 | B1 | * | 3/2001 | Dame et al. | 52/745.1 |
| 6,216,397 | B1 | * | 4/2001 | Chang | 52/36.1 |
| 6,330,749 | B1 | * | 12/2001 | Khachatoorian et al. | 30/162 |
| 6,330,773 | B1 | | 12/2001 | MacDonald et al. | |
| 6,339,907 | B1 | | 1/2002 | Dame et al. | |
| 6,341,457 | B1 | * | 1/2002 | Aerts et al. | 52/239 |
| 6,349,516 | B1 | | 2/2002 | Powell et al. | |
| 6,389,773 | B1 | * | 5/2002 | Reuter et al. | 52/582.2 |
| 6,415,567 | B1 | * | 7/2002 | Mead et al. | 52/239 |

FOREIGN PATENT DOCUMENTS

| | | | | |
|---|---|---|---|---|
| JP | 287361 | * | 11/1989 | 52/239 |
| JP | 112992 | * | 5/1993 | 52/239 |
| JP | 306975 | * | 11/1994 | 52/238.1 |

OTHER PUBLICATIONS

BPI Parallel Cantilevered and Freestanding: Total Systems Furniture Solutions brochure, dated Jul. 2000.
BPI Year 2000 Price List, dated Apr. 2, 2000.

* cited by examiner

*Primary Examiner*—Phi Dieu Tran A
(74) *Attorney, Agent, or Firm*—Ronald A. Sandler; Jones Day

(57) ABSTRACT

An improved wall panel system is disclosed. The system includes wall panel assemblies, each assembly having a pair of side frame members having slotted channels, top and bottom steel tubes and fork connectors for attachment to the side frame members, a top cap, lower metal supports and a plastic base rail channel and cover. The system also includes a universal connector post, a universal I-beam shaped connector, a universal bracket, a variable height bracket and adjustable corner and end caps. The corner and end caps are scored to allow removal of cap walls resulting in an inventory of fewer parts and system versatility. A removal tool is also disclosed.

21 Claims, 19 Drawing Sheets

WALL PANEL SYSTEM

BACKGROUND OF THE INVENTION

1. Field of the Invention

The present invention relates to a wall panel system and more particularly to an improved wall panel system that is strong, versatile and easy to assemble.

2. Description of the Related Art

Wall panel systems typically are used to form office work spaces that are efficient, generally inexpensive when compared to fixed wall offices, and have an ability to be adjustable. Examples of such systems are shown in recently issued U.S. Pat. Nos. 6,339,907; 6,330,773 and 6,349,516, and older U.S. Pat. Nos. 5,743,055 and 4,971,281. These patents are incorporated here by reference as if fully set forth. Existing wall panel systems are also shown in catalogs, such as in BPI's catalog for its PARALLEL brand system. This catalog is also incorporated here by reference as if fully set forth.

Even through wall panel systems have been in existence for many years, systems as those shown in the above mentioned patents can be relatively expensive, difficult to assemble, complicated and not very versatile.

BRIEF SUMMARY OF THE INVENTION

The difficulties encountered by previous systems have been overcome by the present invention. What is described here is a wall panel system comprising a wall panel assembly, the wall panel assembly including two vertically oriented side frame members, a top horizontally disposed frame member being connected to the side frame members and a horizontally disposed top cap connected to the top frame member, an elongated vertically disposed universal connector post, an elongated connector connected to the post and to one of the side frame members, a bracket attached to the top frame member and to the connector post, the bracket having a first end portion including two openings for receiving fasteners to connect to the top frame member, and a second end portion for engaging the connector post, and a corner cap for engaging and covering a top end of the universal connector post. What is also described here is a method for assembling a wall panel system comprising the steps of providing a universal connector post, providing at least two wall panel assemblies, providing vertically disposed I-beam shaped connectors, placing the I-beam shaped connectors into channels in side frame members of the wall assemblies and into channels formed in the universal connector post, providing brackets, fastening the brackets to the wall panel assemblies and to the universal connector post, fastening top caps to the wall panel assemblies, providing a universal corner cap, removing one of more side wall portions from the corner cap to accommodate the brackets, and engaging the corner cap with a top end of the connector post.

There are a number of advantages, features and objects achieved with the present invention which are believed not to be available in earlier related systems. For example, several advantages are that the present invention provides an improved wall panel system which is simply constructed, reliable and inexpensive. The present invention also provides for a very strong wall panel systems which is also durable. Further advantages are that the present invention provides a wall panel system which is versatile and which comprises relatively few parts and parts that are universal and/or able to be configured in the field. Yet another object of the present invention is that the wall panel system is easily and quickly assembled and disassembled. Still another feature of the present invention is to provide an improved wall panel system which is aesthetically pleasing.

A more complete understanding of the present invention and other objects, advantages and features thereof will be gained from a consideration of the following description of a preferred embodiment read in conjunction with the accompanying drawing figures provided herein. The preferred embodiment represents an example of the invention which is described here in compliance with Title 35 U.S.C. section 112 (first paragraph), but the invention itself is defined by the attached claims.

DETAILED DESCRIPTION OF A PREFERRED EMBODIMENT OF THE INVENTION

Figure 1:
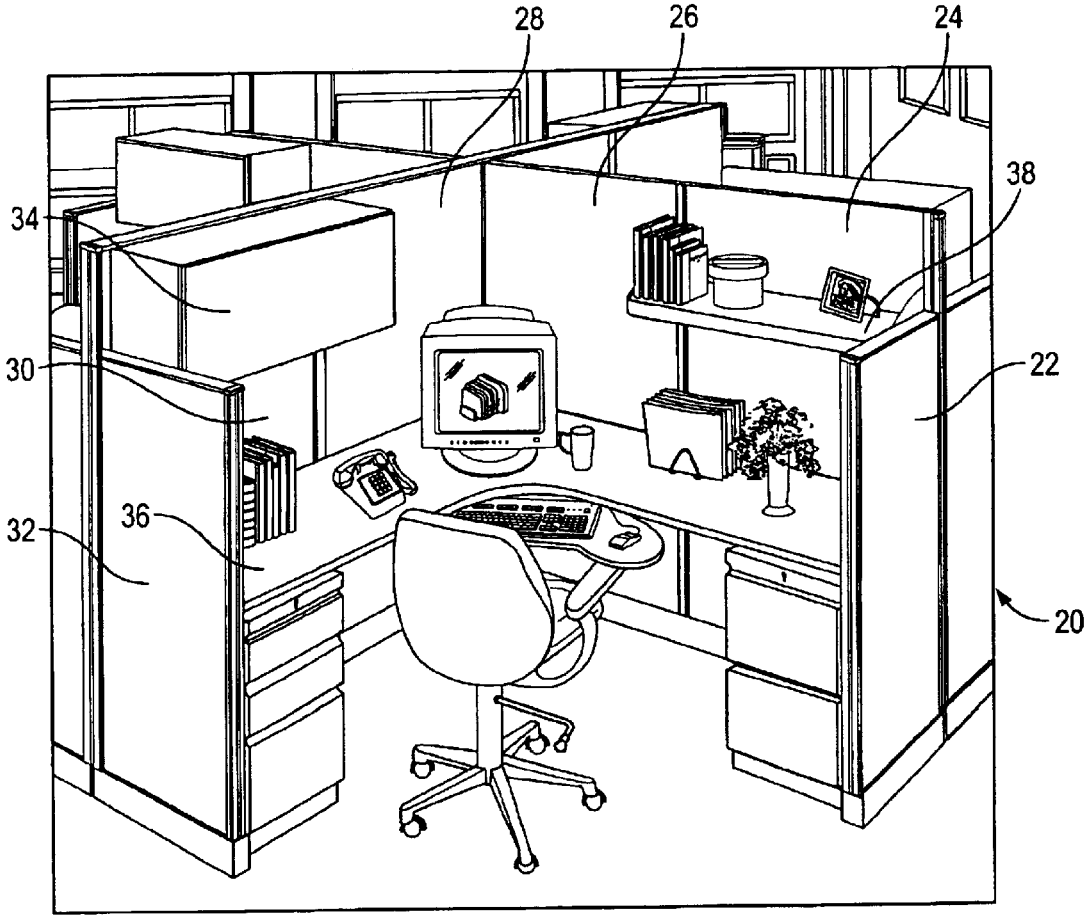
FIG. 1 is an isometric view of a wall panel system as it appears when fully assembled.

While the present invention is open to various modifications and alternative constructions, the preferred embodiment shown in the various figures of the drawing will be described herein in detail. It is understood, however, that there is no intention to limit the invention to the particular embodiment, form or example disclosed. On the contrary, the intention is to cover all modifications, equivalent structures and methods, and alternative constructions falling within the spirit and scope of the invention as expressed in the appended claims, pursuant to Title 35 U.S.C. section 112 (second paragraph).

An example of an office wall panel system 20 is illustrated in FIG. 1 where several different wall panel assemblies 22, 24, 26, 28, 30, 32 are illustrated. It is noted that the wall panel assemblies are not all of equal height or width. Attached to the wall panel assemblies, by way of example, are a storage cabinet 34, a desk 36 and a shelf 38. The arrangement shown in FIG. 1 also exemplifies how such a wall panel system may easily be formed into a cluster of four work spaces.

Figure 2:
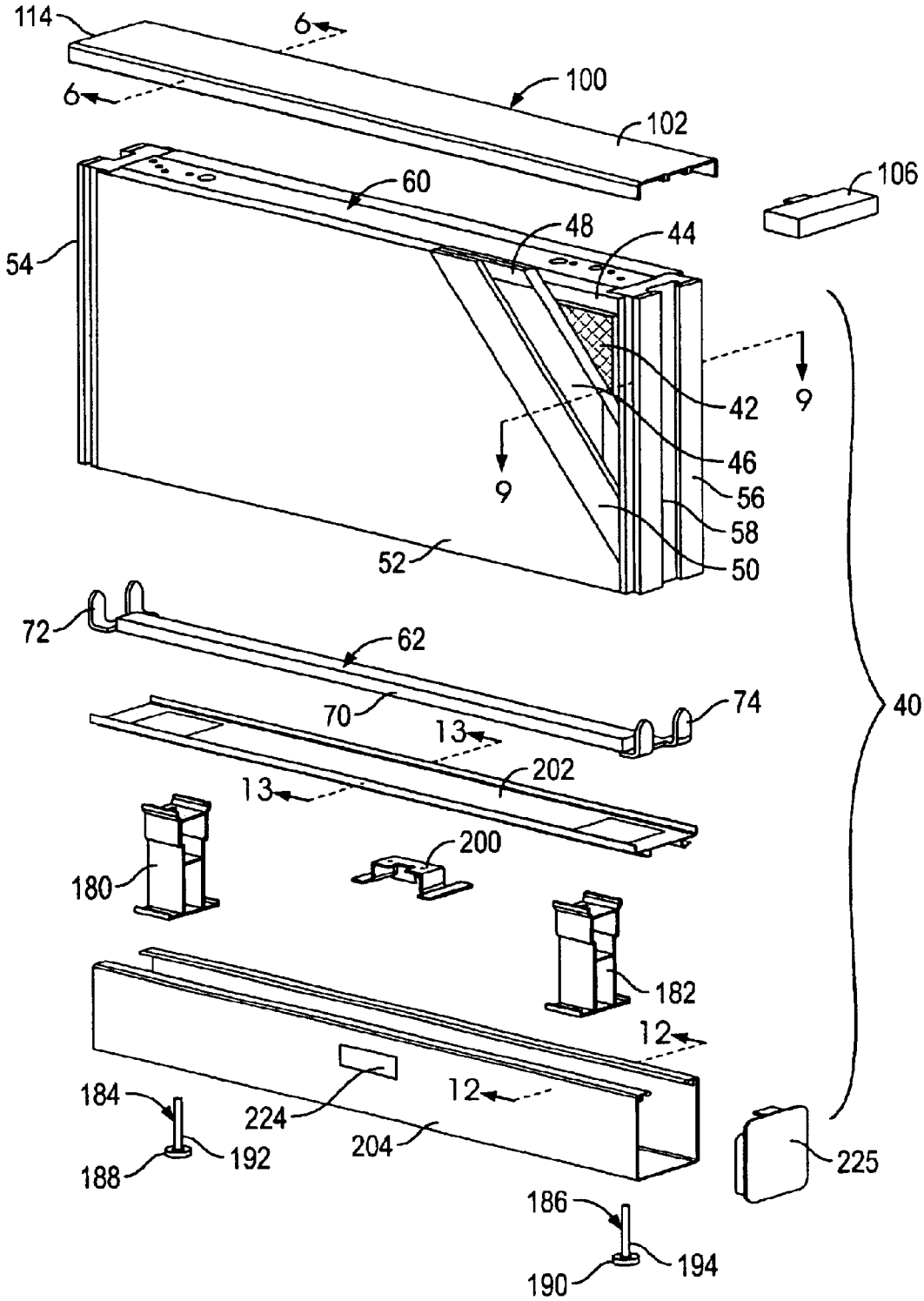
FIG. 2 is an isometric view, partially exploded and partially broken away of a wall panel assembly.

Referring now to FIG. 2, a wall panel assembly 40 is described in more detail. The wall panel assembly has an overall height of between about thirty inches and eighty-one inches and an overall width of between about twenty-four inches and sixty inches. The wall panel assembly includes a honeycomb core 42 placed within an inner wooden frame 44 made from one inch by three-quarter inch fir, pine or maple. Covering the wooden frame and the honeycomb core is a hardboard layer 46, either solid or perforated, about one-eighth inch thick. An edge strip 48 of PVC plastic is mounted around the periphery of the hardboard. Next a fiber glass layer 50, approximately one-quarter inch thick, may be fastened by staples or adhesive to the hardboard. Fabric 52 is stretched over the fibreglass and stapled to the inner frame. A similar arrangement is formed on the opposite side of the assembly but not shown here. Vertical side frame members 54, 56, made of aluminum and having outward opening slots, such as the slot 58, are attached and form the lateral ends of the assembly. The aluminum is at least 0.058 inches thick and two inches wide, matching the width of the wall panel assembly.

At upper and lower ends of the assembly there are a top frame assembly 60 and a bottom frame assembly 62 which connect to the vertical side frame members 54, 56. The bottom frame assembly is horizontally disposed and includes a tube 70 of sixteen gauge steel having a generally rectangular cross section one inch by three-quarters inch. Steel fork elements 72, 74 may be welded to the ends of the bottom tube, or each element may be a separate piece 76, FIG. 3, made of zinc die cast which is then press fitted into the bottom steel tube. The top frame assembly 60, FIGS. 2, 4 and 5, includes a top tube 80 and oppositely press-fitted zinc forks 82, 84 or welded steel forks. Each tube has fastener openings, such as screw holes 86, 88, 90, 92 and snap fastener openings 93, 94, 96. The top and bottom tubes are the same except for different hole patterns.

A decorative top cap assembly 100, FIG. 2, is provided to cover the top frame assembly. The top cap assembly includes a top cap 102 of aluminum having at least a 0.070 inch thickness and a top cap attachment clip (not shown) which is made of 0.06 inch diameter spring steel wire. PVC plastic snaps (not shown) may be used as an alternative. Top end caps, such as end cap 106, made of zinc, or an alloy of zinc, are also included in the top cap assembly. The end caps may be scribed or scored to allow breakouts for bracket clearance as will be described below.

Figure 3:
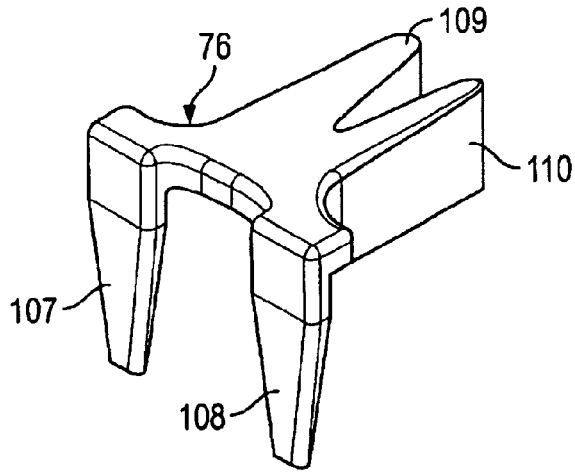
FIG. 3 is an enlarged isometric view of a fork insert shown in FIG. 2.
Figure 4:
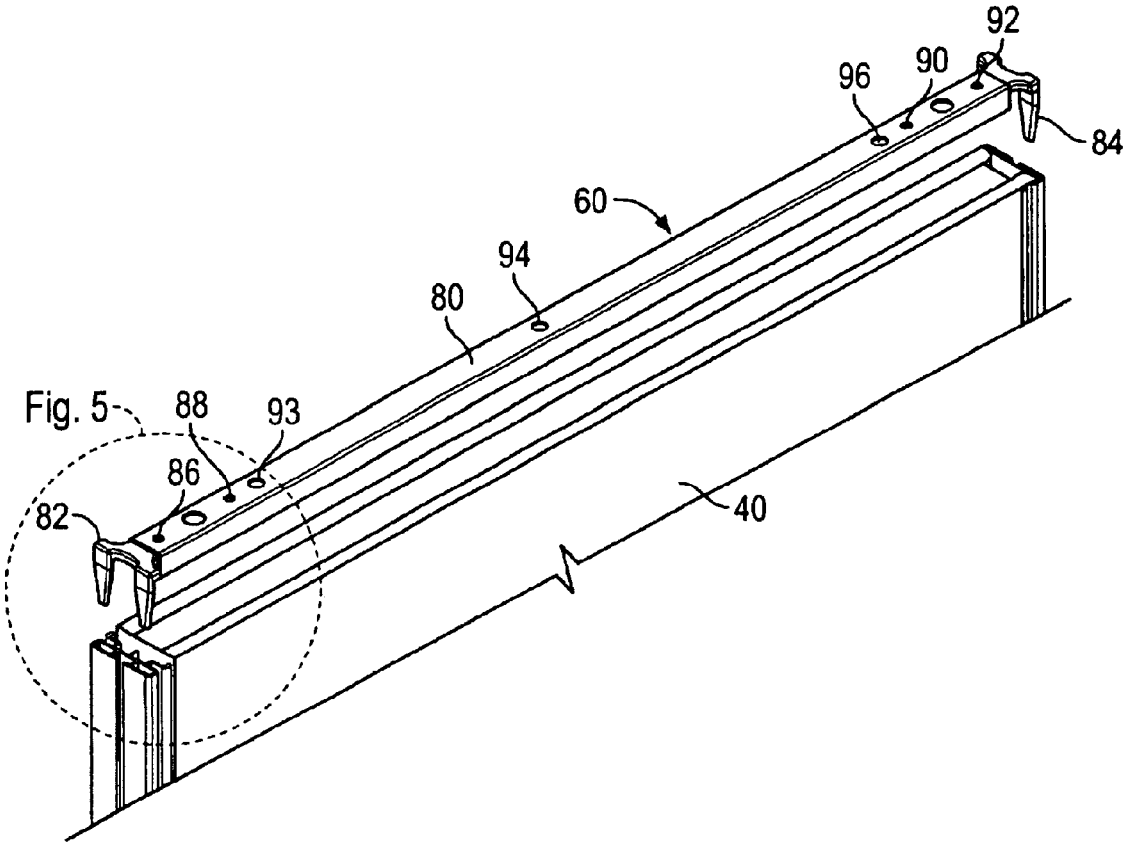
FIG. 4 is an exploded partial isometric view of the upper portion of the wall panel assembly shown in FIG. 2.
Figure 5:
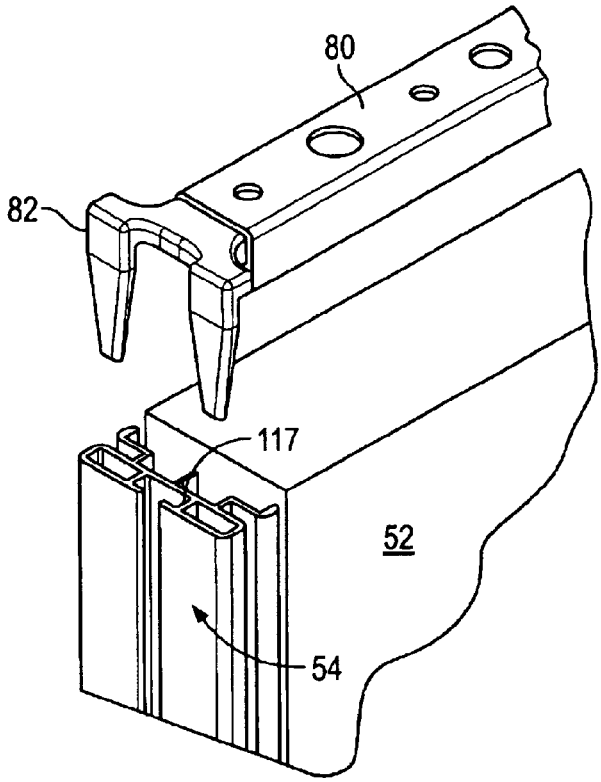
FIG. 5 is an enlarged isometric view taken within circle 5—5 of FIG. 4.

The fork elements include two vertically depending prongs 107, 108, FIG. 3, and two horizontally disposed arms 109, 110 which are press fitted to a tube as shown clearly in FIG. 5.

Figure 6:
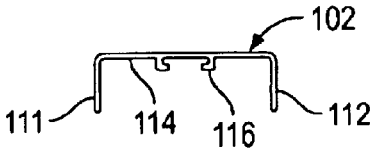
FIG. 6 is an enlarged sectional elevation view taken along line 6—6 of FIG. 2.

Referring now to FIG. 6, the top cap 102 is U-shaped with side arm portions 111, 112 and a base portion 114. The top cap may be extruded and includes an open channel 116 into which is connected to the attachment clip.

Figure 7:
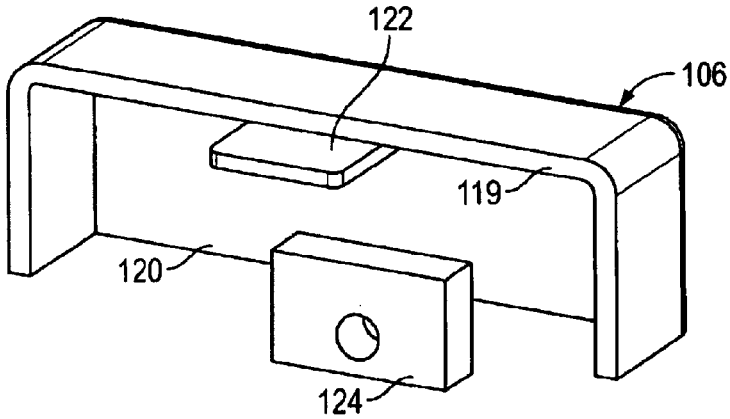
FIG. 7 is an enlarged isometric view of a end cap shown in FIG. 2.
Figure 8:
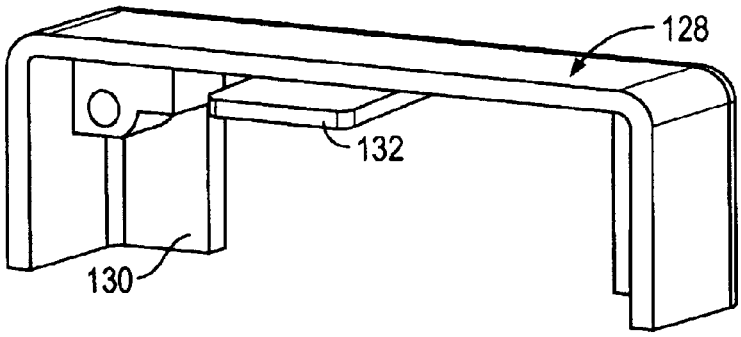
FIG. 8 is an enlarged isometric view of a transition cap.

The end cap 106, FIG. 7, includes a U-shaped element 119 with a cover or end wall 120, a horizontal tab 122 and a vertical tab 124. The horizontal tab is received within the channel 116 of the top cap 102, FIG. 6. The vertical tab is received in a similar channel 117, FIG. 5, formed in the side frame member 54. A similarly constructed transition cap 128, FIG. 8, is also shown and is identical to the end cap 106 except that a portion of the end wall 130 is removed along with the vertical tab. Scores are made in the end cap so that a wall portion may be removed in the field to modify and end cap into a transition cap. This technique results in a fifty percent reduction in inventory in such caps because two separate parts are not needed. Like the end cap, the transition cap includes a horizontal tab 132 to engage the channel 116 of the top cap 102.

Figure 9:
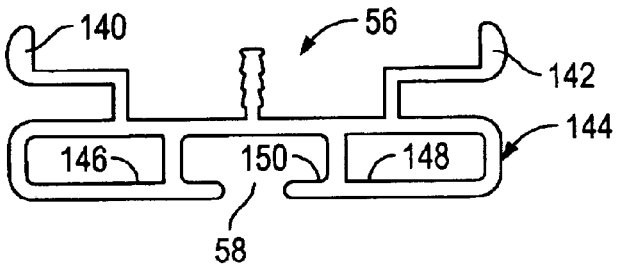
FIG. 9 is an enlarged sectional plan view of a side frame member taken along 9—9 of FIG. 2.

Referring now to FIG. 9, a cross section of the side frame member 56 is shown in more detail. The side frame member 56 includes two arms 140, 142 for protecting the edges of two fabric covered fibreglass layers. An outer portion 144 of the side frame member includes spaced apart elongated channels 146, 148 having rectangular cross sections integral with an elongated central open channel 150, the opening being formed by the slot 58. The spaced apart channels 146, 148 receive the prongs of the steel forks which are connected to the top and bottom tubes. When connected, each wall panel assembly includes a metal periphery or frame. The central open channel 150 is designed to receive the vertical tab 124 of the end cap as well as a universal I-beam shaped vertical connector 160.

Figure 10:
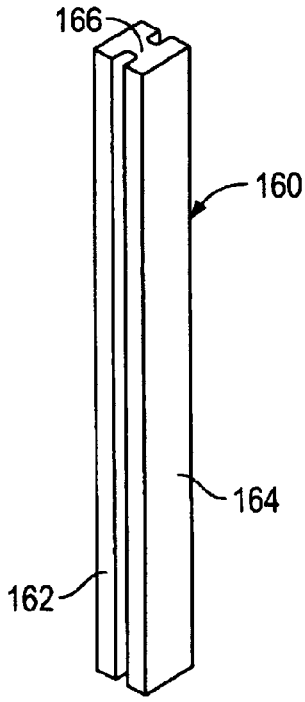
FIG. 10 is an isometric view of a universal I-beam shaped connector.
Figure 11:
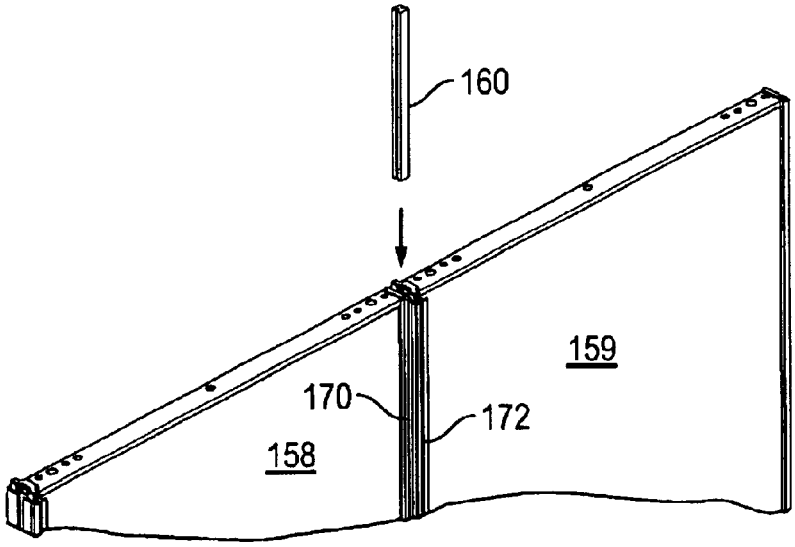
FIG. 11 is an exploded partial isometric view of two wall panel assemblies being connected by an I-beam shaped connector.

The I-beam connector is shown in more detail in FIG. 10 and maybe made of any suitable material, such as a synthetic resin. The vertical connector is used to easily connect wall panel assemblies and to block light. As shown in FIG. 11, when two panel assemblies 158, 159 are aligned in a straight line, the vertical connector 160 is installed in the adjacent open channels of the adjacent wall panel assemblies 158, 159. The vertical connector includes two arms 162, 164, FIG. 10, and a bridge or middle portion 166. As also shown in FIG. 11, each arm of the universal connector is received in the central open channels of side-by-side located side frame members 170, 172 of the aligned wall panel assemblies. Each vertical connector is approximately twelve inches in length so that multiple vertical connectors are used depending upon the height of the wall panel. For example, two vertical connectors are used for a 30 inch high panel, three vertical connectors are used for a 42 inch high panel, four vertical connectors for a 55 inch high panel, five vertical connectors for a 68 inch high panel and six vertical connectors for an 81 inch high panel. As will be explained in relation to FIG. 19, universal vertical connectors are also used when a universal connector post is present. Not only does the vertical I-beam shaped connector physically secure one wall panel assembly to another, but it acts as a light block in addition so that an aesthetically pleasing wall results. The vertical connectors are received in slotted channels of the side frame members and similar slotted channels of the universal connector post. The slotted channels of the side frame members are bent at the bottom to block further downward travel of the vertical connectors after they are dropped into the channels.

At the lower end of the wall panel assembly are two die cast zinc panel supports 180, 182, FIG. 2, with a uniform wall thickness of about 0.076 inches. The panel supports are attached to the bottom steel tube 70 by screws. Adjustable panel glides 184, 186 which have plastic bases 188, 190 molded to threaded stems 192, 194 are provided to be threadedly received by the panel supports and allow each wall panel assembly to be height adjusted simply by rotating the panel glides clockwise or counterclockwise.

Figure 12:
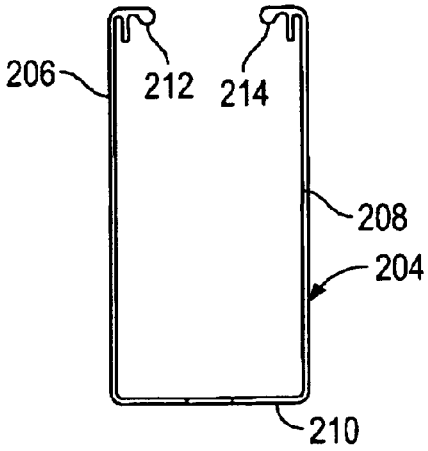
FIG. 12 is an enlarged sectional elevation view of a base rail cover taken along line 12—12 of FIG. 2.
Figure 13:
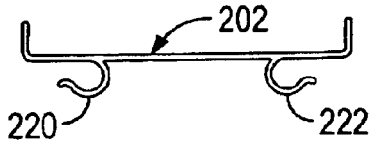
FIG. 13 is an enlarged sectional elevation view of a base rail channel taken along line 13—13 of FIG. 2.

Also mounted at the bottom of the wall panel assembly 40 is an electrical mounting bracket 200 of twelve gauge steel also screwed to the bottom tube 70. Enclosing the panel supports 180, 182, the electrical mounting bracket 200 and any electrical wiring and/or cables that may run along the bottom of a wall panel assembly is a base rail cover assembly comprising a base rail channel 202 made of PVC plastic which is attached to the bottom tube 70 and a mating base rail cover 204 also of PVC plastic which may be bent in a U-shape. The U-shape base rail cover 204 includes two arms 206, 208, FIG. 12, a base 210 and beads 212, 214 at the extremities of the arms. The beads are received in circular channel members 220, 222, FIG. 13, of the base rail channel 202. It can be appreciated that one or both of the arms of the base rail cover may be disengaged from the base rail channel to allow access to the space at the bottom of a wall panel assembly to allow repair or installation of communication or electrical wiring. More details relating to the material and construction of the base rail cover may be acquired by reference to U.S. Pat. No. 4,463,046. Included in the base rail cover may be an opening which is covered by a receptacle hole cover 224, FIG. 2, also made of PVC and positioned by snap fitting into place. As will be explained below, a base rail end cap 225 is provided to complete the bottom portion of the wall panel assembly and the cap 225 may be made of ABS plastic.

Figure 14:
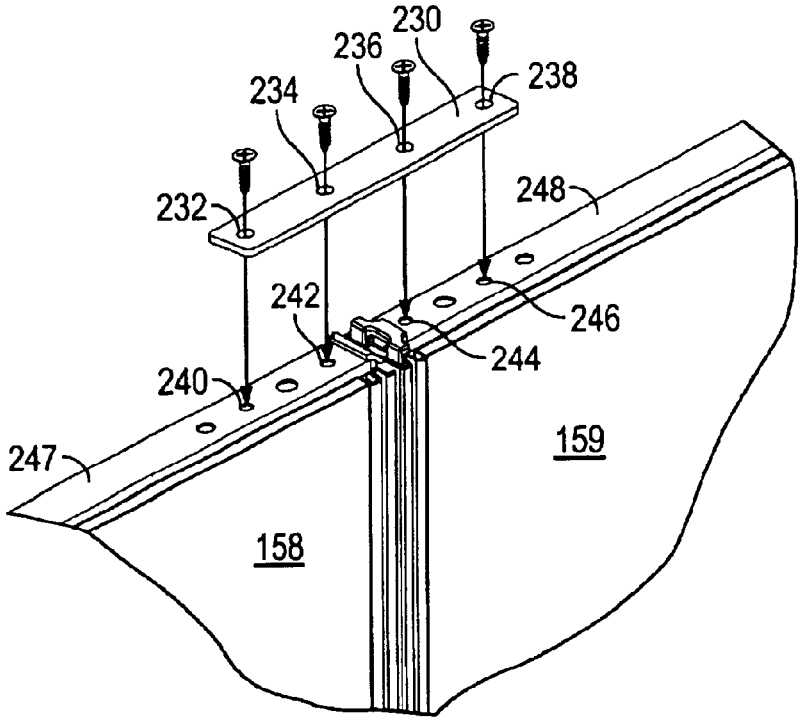
FIG. 14 is an enlarged exploded partial isometric view of the two wall panel assemblies shown in FIG. 11 being attached with a straight bracket and screw fasteners.
Figure 15:
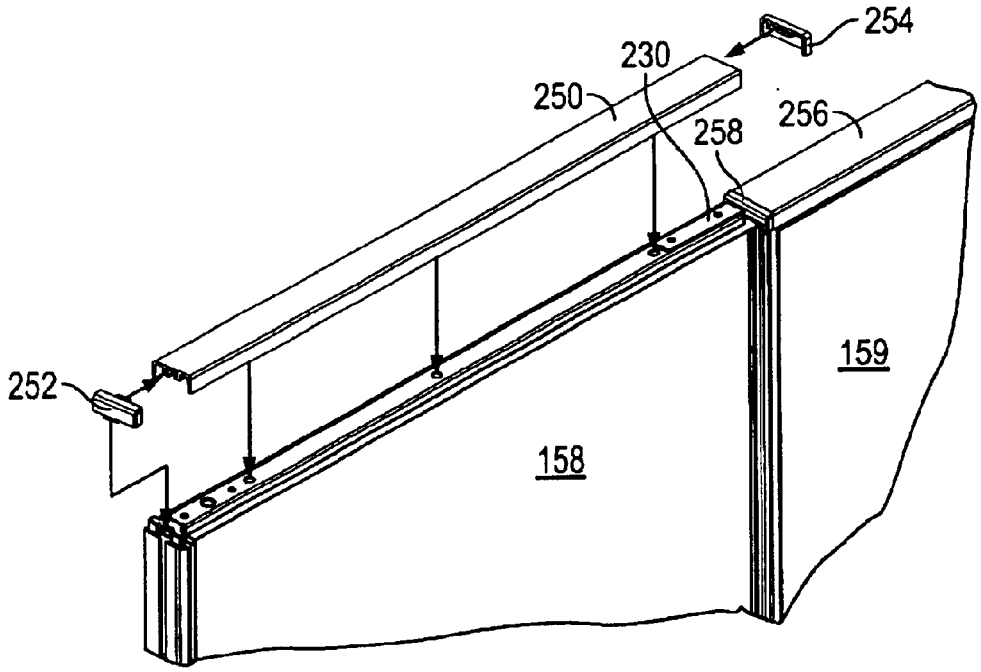
FIG. 15 is a smaller exploded partial isometric view of the two wall panel assemblies shown in FIGS. 11 and 14, including the next step of assembly comprising the addition of a top cap, end cap and transition cap to the wall panel assemblies.

In FIGS. 14 and 15, continued assembly of a wall panel system is illustrated. A top strip bracket 230 fastens the two wall panel assemblies 158, 159 together after the vertical connectors 160 are installed. As can be seen, the strip bracket includes four fastener openings 232, 234, 236, 238 which align with fastener openings 240, 242, 244, 246 on the top tubes 247, 248. Thereafter, a top cap 250 (identical to the top cap 102, FIG. 2) is installed. To finish off the top of the wall panel assembly 158, there is an end cap 252 (identical to the end cap 106, FIG. 7) and a transition cap 254 (identical to the transition cap 128, FIG. 8) which are used in conjunction with the top cap. Another top cap 256 and transition cap 258 sit atop the wall panel assembly 159. It is noted that portions of the end walls of the transition caps have been removed to accommodate the strip bracket 230.

Figure 16:
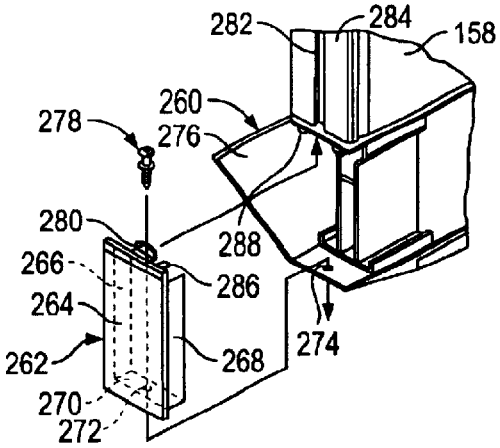
FIG. 16 is an enlarged exploded partial isometric view of a lower section of one of the wall panel assemblies in FIGS. 11, 14 and 15 showing the installation of a base end cap.

Referring now to FIG. 16, at the bottom of the wall panel assembly, a base rail cover assembly 260 forms a U-shaped channel that is still open at its end. To close that opening, a base rail end cap 262, shown also in FIG. 2, as end cap 225, is used. The end cap has an end wall 264, two arms 266, 268 and a base 270. The base includes an opening 272 which can align with an opening 274 in the base rail cover 276 and both may receive a fastener 278 to secure the base rail end cap in place. To also help secure the base rail end cap, a vertical tab 280 is received by the open channel 282 in the vertical side frame member 284 and a horizontal tab 286 is received by the base rail channel 288. The combination of the base rail cover 276 and the base rail end cap 262 provides an aesthetic appearance to the wall panel system as well as protection of the wall panel system from abuse that may result from a vacuum cleaner, for example.

Figure 17:
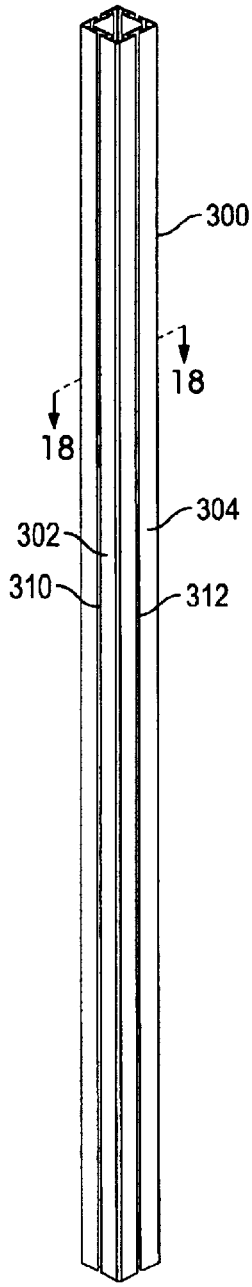
FIG. 17 is an isometric view of a universal connector post.
Figure 18:
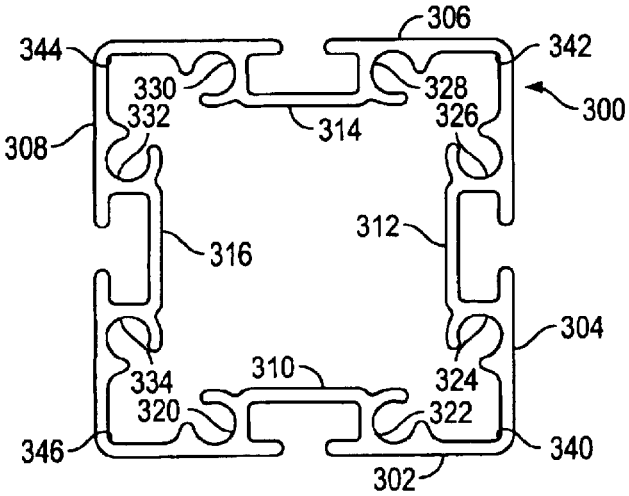
FIG. 18 is an enlarged sectional plan view taken along line 18—18 of FIG. 17.
Figure 19:
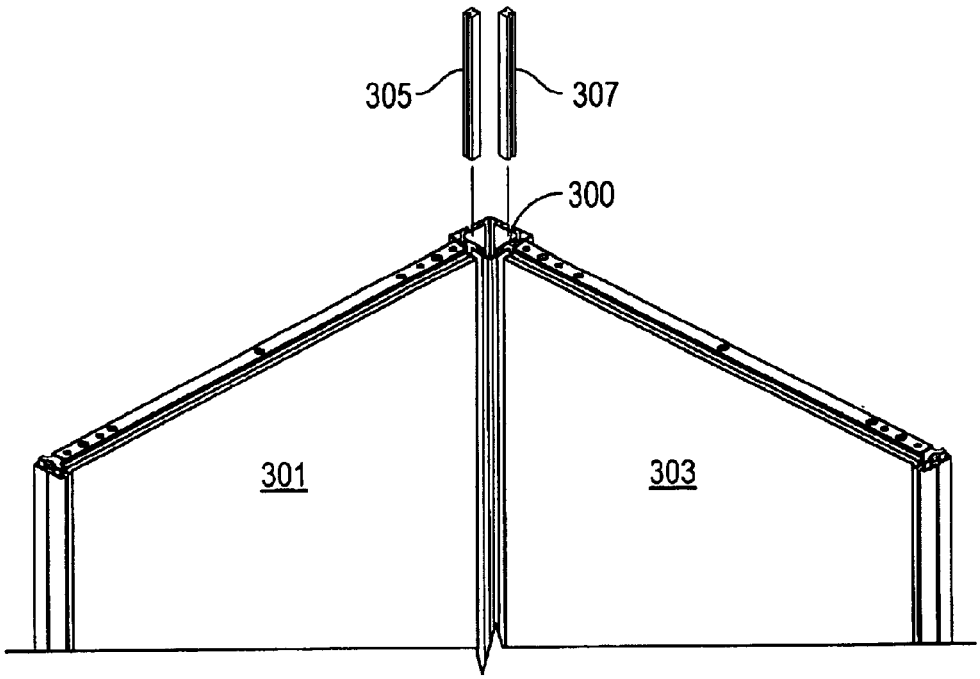
FIG. 19 is an exploded partial isometric view illustrating the installation of two wall panel assemblies to the universal connector post where the wall panel assemblies are disposed at 90 degrees to one another.

Referring now to FIGS. 17 and 18, a universal connector post 300 is shown in detail. The connector post is intended to extend almost along the entire vertical length of a wall panel assembly and because of its particular shape, wall panel assemblies of different heights may be easily connected to the connector post. Further, the connector post is extremely versatile so that it may be used to connect two panels in a linear arrangement, at ninety degrees, in a T-shaped formation or in an X configuration. For example, in FIG. 1 the wall panel system is illustrated in an X-shape configuration with a universal connector post at the center of the configuration. A ninety degree configuration is illustrated in FIG. 19 where two wall panel assemblies 301, 303 abut the universal connector post 300 and two I-beam connectors 305, 307 are about to be installed. The post has a generally square cross sectional configuration with four outer walls 302, 304, 306, 308, FIG. 18, and including four equally spaced open rectangular channels 310, 312, 314, 316, each of which is flanked by a pair of small open circular channels 320, 322, 324, 326, 328, 330, 332, 334. The outer walls create four interior corners 340, 342, 344, 346. The circular channels are used to receive fasteners, such as screws. The rectangular channels are fashioned to receive one arm of the I-beam connector 160 so that a side frame member of a wall panel assembly may be attached to the connector post using I-beam connectors. The connector post is also engageable by specially designed brackets so that connected wall panel assemblies may be securely fastened to the connector post. This creates an extremely strong and robust wall panel system. The universal connector post may be made of extruded aluminum for ease of construction and low cost.

Figure 20:
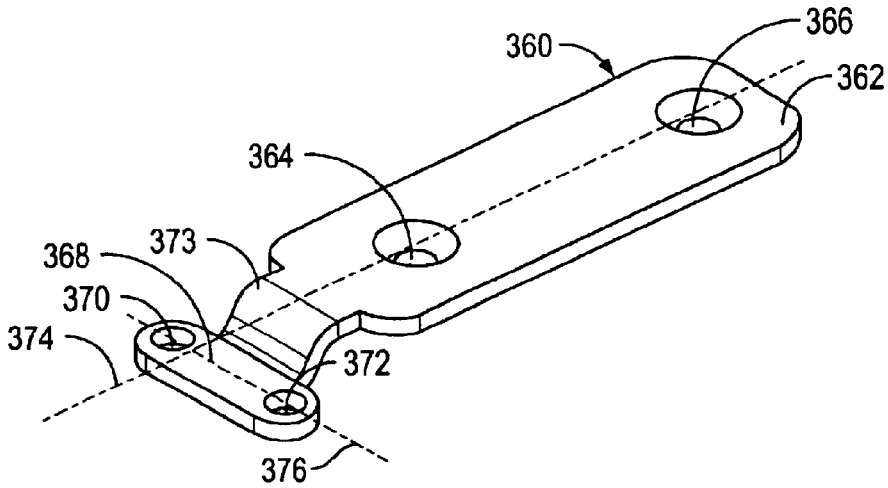
FIG. 20 is an enlarged isometric view of a universal bracket used to attach the wall panel assembly to the universal connector post.
Figure 21:
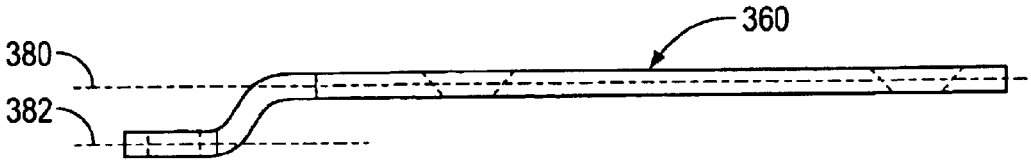
FIG. 21 is a side elevation view of the universal bracket shown in FIG. 20.

Referring now to FIGS. 20 and 21, there is illustrated a universal bracket 360 used to fasten a wall panel assembly to the connector post. The bracket may be formed of stamped steel having a long end portion 362 with two fastener openings 364, 366, a short end portion 368 also with two fastener openings 370, 372 and a neck portion 373. It is apparent that a line 374 connecting the two long portion openings 364, 366 is perpendicular to a line 376 connecting the two short portion openings 370, 372 although a plane 380 of the long end portion is at a higher elevation than a plane 382 of the short end portion. Each wall panel assembly is connected to a connector post using four screw fasteners 384, 386, 388, 390, FIG. 22, where two of the fasteners 384, 386 connect the bracket long end portion 362 to a top tube 392 of the panel assembly 303 whereas the other two fasteners 388, 390 attach the short end portion 368 of the bracket to the connector post 300. The connector post receives the fasteners 388, 390 in the pair of circular channels 324, 326, FIG. 18, to each side of the rectangular channel 312.

Figure 23:
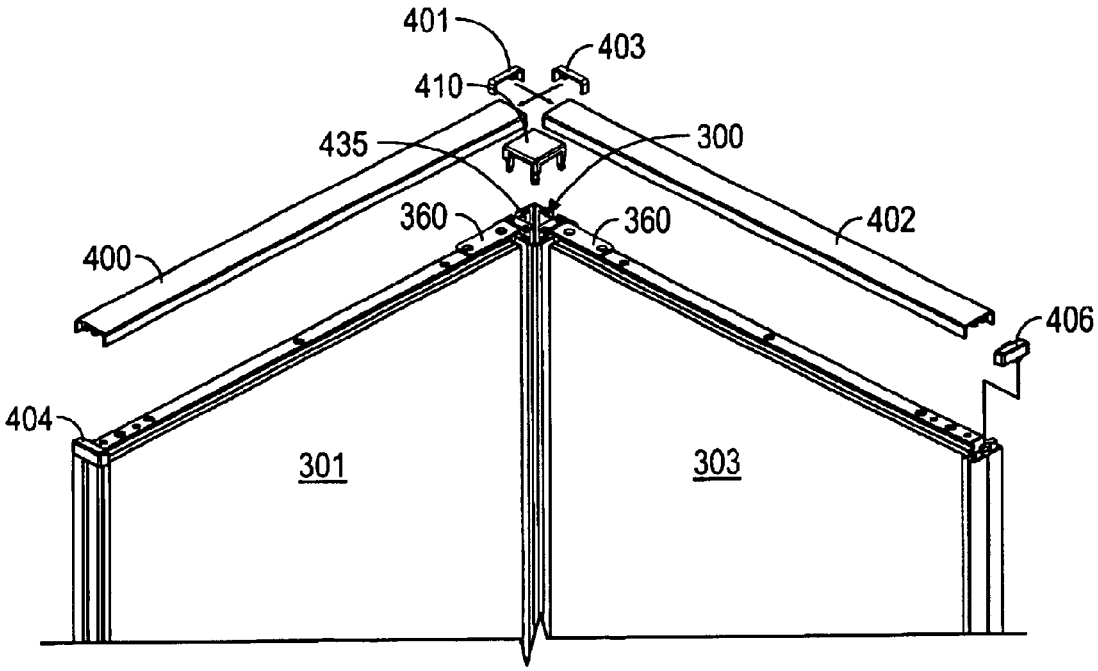
FIG. 23 is an isometric view similar to those shown in FIGS. 19 and 22 illustrating the installation of top caps, transition caps and an end cap as well as a universal corner cap.

After each of the wall panel assemblies is connected to the connector post using universal brackets, top caps 400, 402, FIG. 23, are then fastened to the wall panel assemblies 301, 303. Transition caps 401, 403 are mounted near the connector post and end caps 404, 406 are mounted at the far ends of the top caps. Mounted to the top end of the connector post is a universal corner cap 410.

Figure 24:
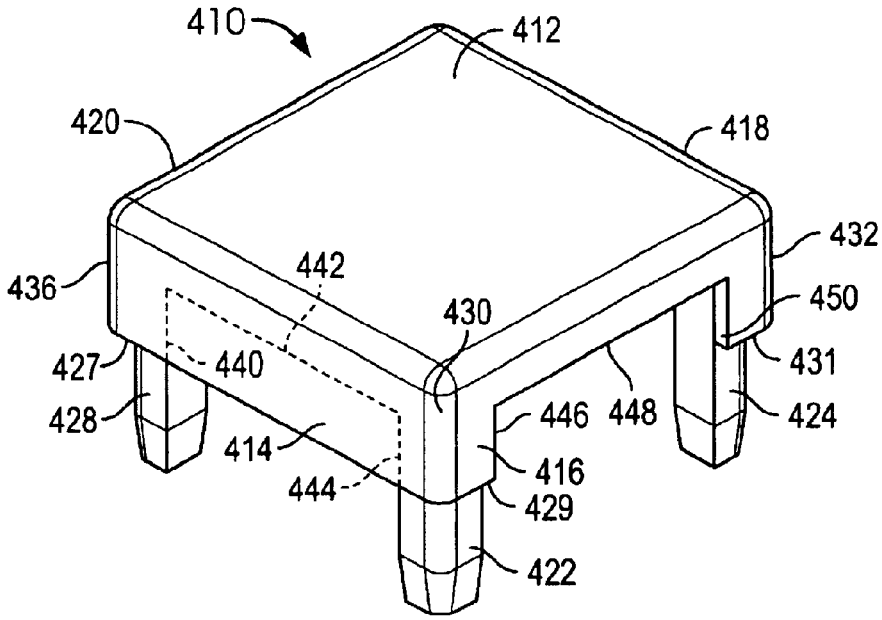
FIG. 24 is an enlarged isometric view of a corner cap similar to that shown in FIG. 23.
Figure 25:
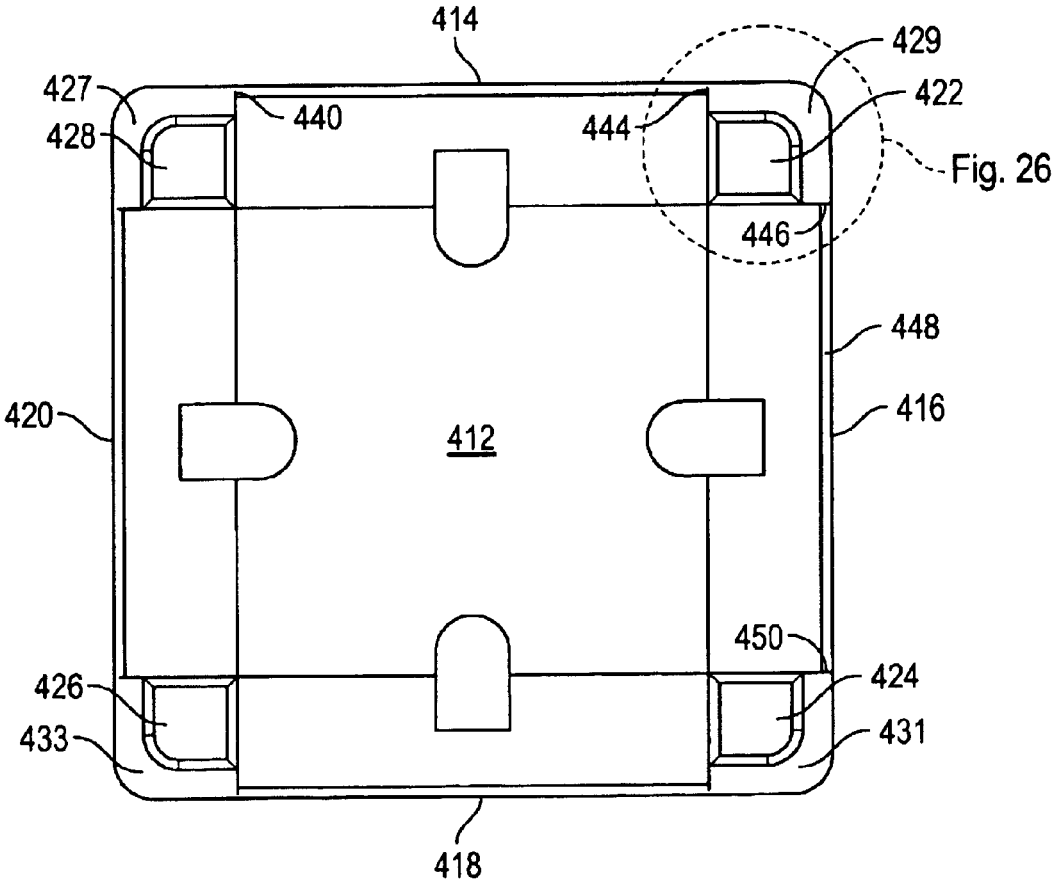
FIG. 25 is a bottom plan view of the corner cap shown in FIG. 24.
Figure 26:
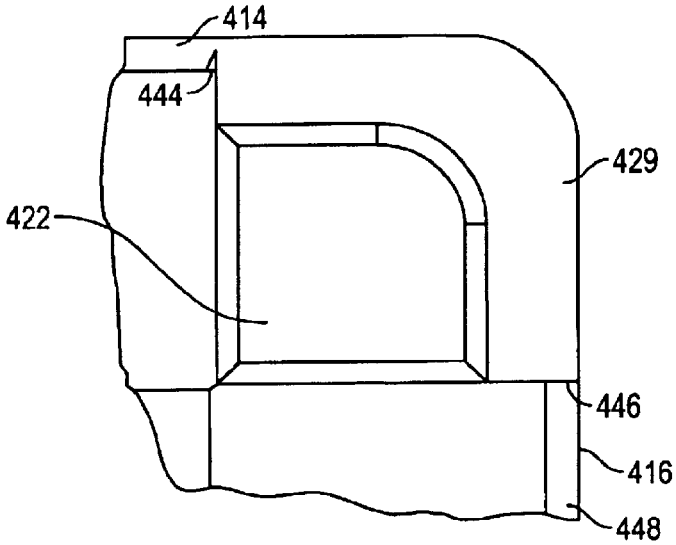
FIG. 26 is an enlarged view taken within the circle 26—26 of FIG. 25.

In FIGS. 24, 25 and 26, the corner cap 410 which fits over and encloses the universal connector post, is shown in more detail. The corner cap is preferably made of zinc die-cast material and includes a top wall 412, four side walls 414, 416, 418, 420 and four leg members 422, 424, 426, 428 extending downwardly from the top wall and along corners 430, 432, 434, 436 where the side walls intersect. Each leg includes a shoulder 427, 429, 431, 433 for abutting a top edge 435, FIG. 23, of the connector post.

The corner cap has generally the same outer dimension as the exterior dimensions of the universal connector post. The legs of the corner cap are received in the post corners 340, 342, 344, 346, FIG. 18. When this occurs, an aesthetic appearance is achieved and there is a generally level top surface that extends along the wall panel assemblies and at the connector post. Also formed in the corner cap are scores or scribes 440, 442, 444 placed in the side walls adjacent to each of the legs and adjacent to the intersection of the side walls and the top wall. The scores provide flexibility, adjustability and versatility to the corner cap to match the versatility of the connector post. The scores allow stress to be concentrated so that an installer is able to remove portions of one or more of the walls depending upon the geometry of the wall panel system to be erected. For example, in the configuration shown in FIG. 23, portions of two adjacent walls have been removed. In the configuration shown in FIG. 24, the side wall 416 has been partially removed leaving edges 446, 448, 450. Removal is simply accomplished by gripping a wall with a pliers and applying torque. If the configuration of the wall panel system is to appear as in FIG. 1, the X configuration, then all four of the walls are partially removed from the corner cap. On the other hand, if wall panels are aligned in a linear fashion, then opposite corner cap walls are partially removed and if the configuration is T-shaped, then three of the corner cap walls are partially removed. In this fashion, the corner cap, a single item in inventory, can be used no matter which of the possible wall panel configurations is desired. The corner cap may even be reused when there is a change of configuration if the change necessitates the same spaces in the corner cap or the removal of other walls. It is to be noted that analogous scores to the scores 440, 442, 444 are formed about each of the walls 416, 418, 420 although not clearly shown.

Figure 27:
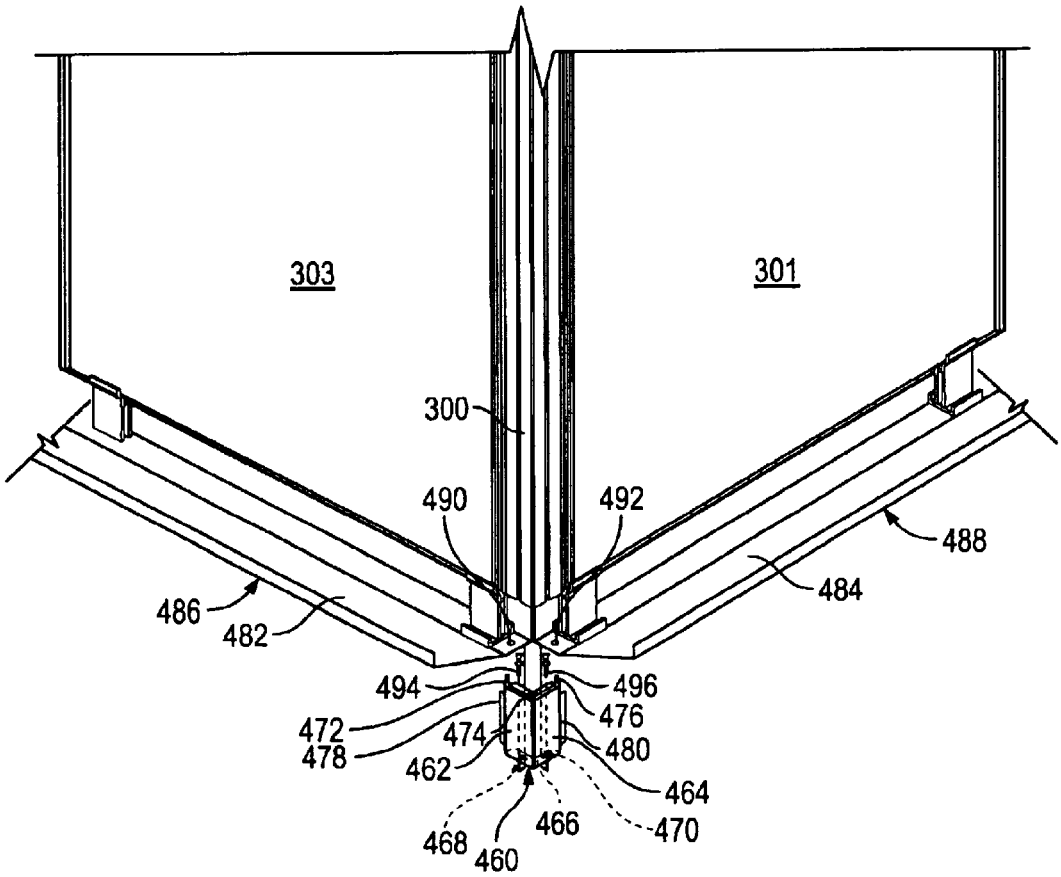
FIG. 27 is an exploded partial isometric view illustrating the installation of a base corner to the two wall panel assemblies attached to the universal connector post.
Figure 28:
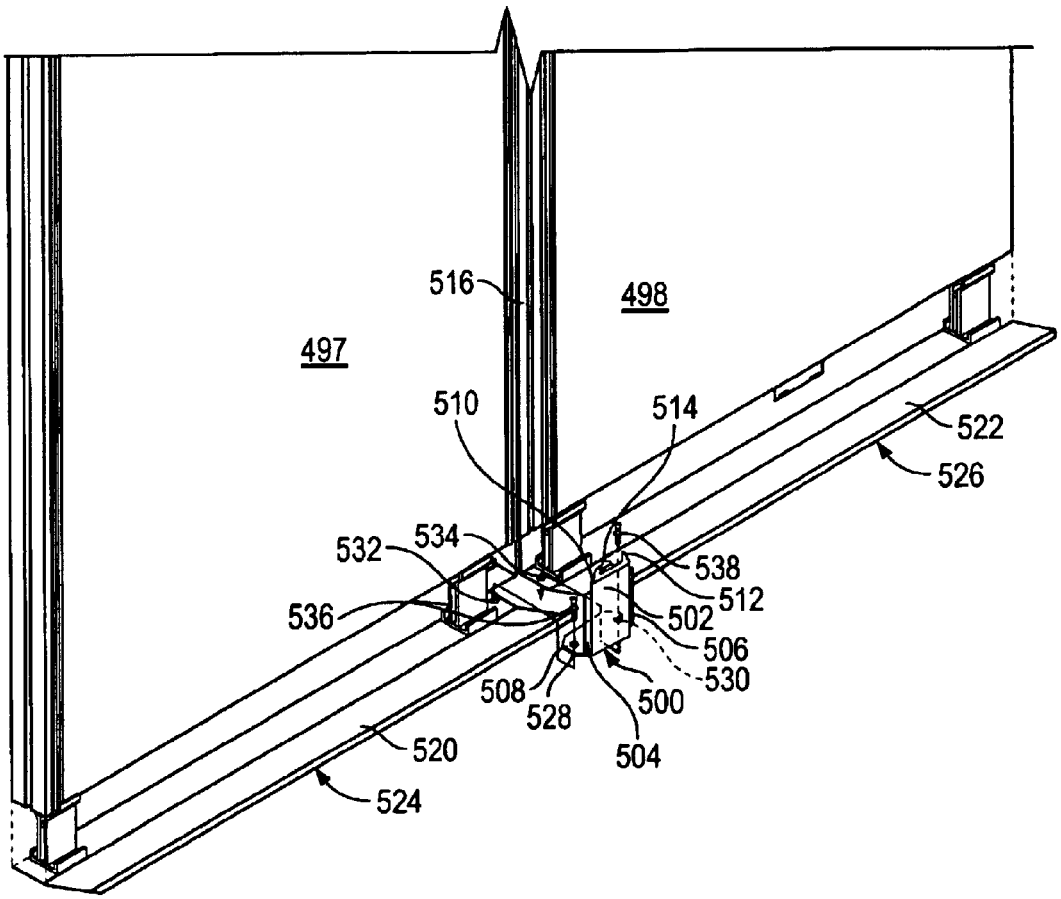
FIG. 28 is an exploded partial isometric view of two linearly configured wall panel assemblies attached to a connector post.

In FIGS. 27 and 28, there is illustrated corner and straight base caps which are used to finish off an installation such as that shown in FIG. 1. In FIG. 27, a ninety degree configuration is shown from the outside, whereas in FIG. 23, the ninety degree configuration if shown from the inside. The corner base cap 460 includes two walls 462, 464 at ninety degrees to one another, a base wall 466 having fastener openings 468, 470, three upstanding tabs 472, 474, 476 and two insert tabs 478, 480. The two insert tabs slide adjacent the internal surfaces 482, 484 of the base rail covers 486, 488. The three tabs 472, 474, 476 engage three of the corners of the connector post 300. The fastener openings 468, 470 in the corner base cap align with fastener openings 490, 492 in the base rail covers and plastic fasteners 494, 496 may be installed to create an interference fit so as to retain the corner base cap in position and allow it to accept the usual abuse common to office spaces without detracting from the aesthetic appearance of the wall panel system.

Where the wall panel assemblies 497, 498 are aligned in a linear fashion as shown in FIG. 28, a straight base cap 500 is provided having an outer wall 502, two insert tabs 504, 506, a base wall 508, two vertical tabs 510, 512 and a channel tab 514. The straight base cap engages the corners of a connector post 516 with the two vertical tabs 510, 512 and the channel of the connector post receives the channel tab 514. The insert tabs 504, 506 fit adjacent the inner surfaces 520, 522 of the base rail covers 524, 526 while the base wall 508 with two fastener openings 528, 530 align with the fastener openings 532, 534 in the base rail covers. Plastic inserts 536, 538 may be used to create an interference fit so that a strong and durable connection is made between the straight base cap and the base rail covers. This is done without interfering with the base rail covers ability to open the spaces beneath the wall panel assemblies.

Figure 29:
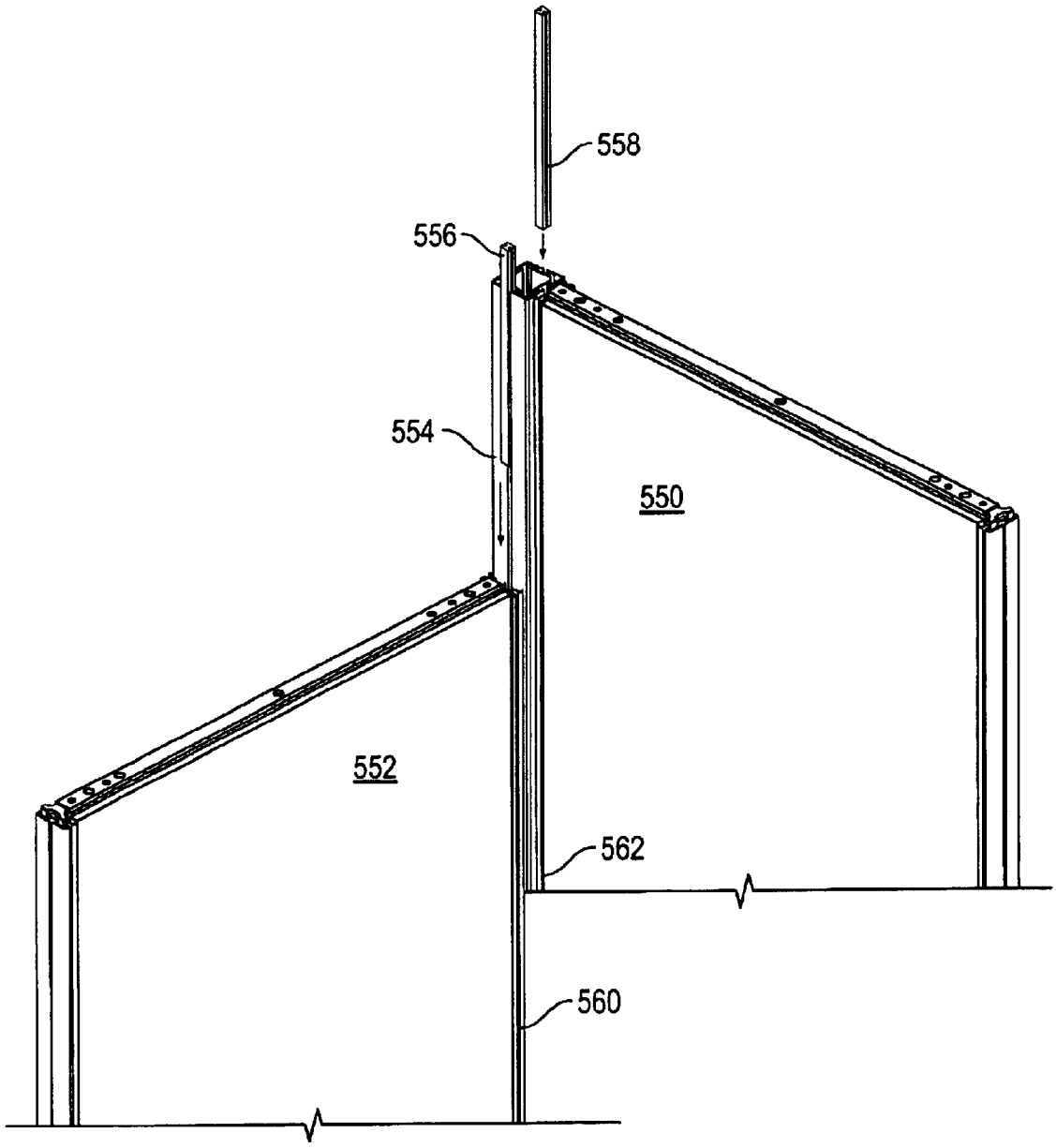
FIG. 29 is an exploded partial isometric view illustrating taller and shorted wall panel assemblies being connected to a universal connector post.
Figure 30:
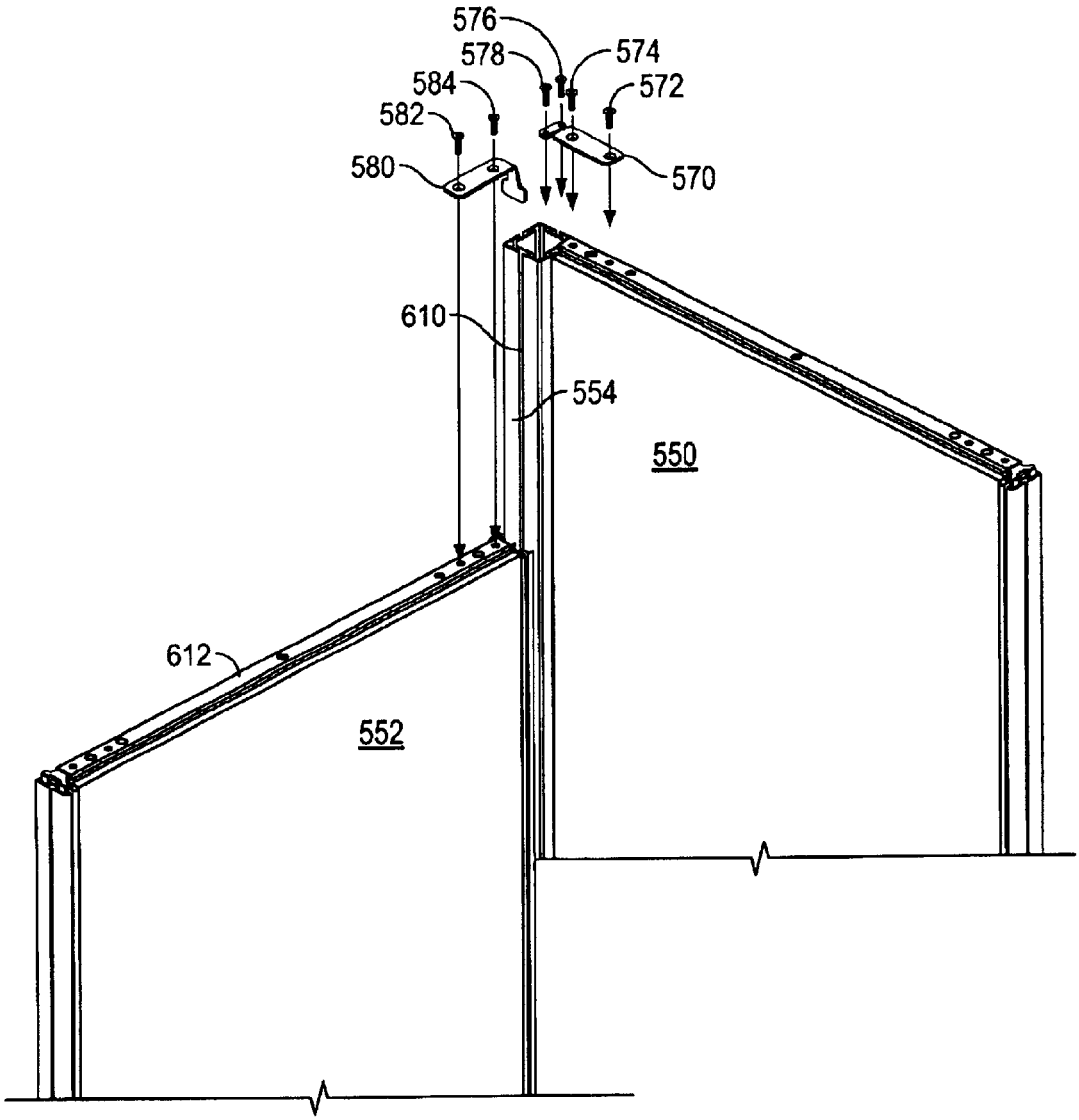
FIG. 30 is an exploded partial isometric view of the wall panel assemblies shown in FIG. 29 illustrating the installation of a universal bracket and a variable height bracket.
Figure 31:
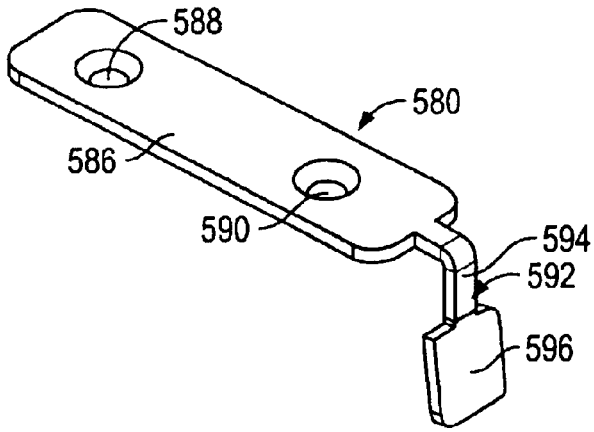
FIG. 31 is an enlarged isometric view of the variable height bracket shown in FIG. 30.
Figure 32:
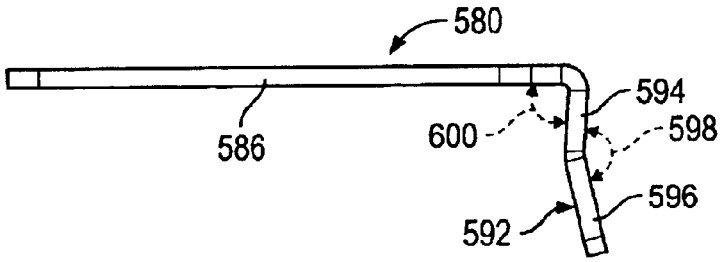
FIG. 32 is a side elevation view of the variable height bracket shown in FIG. 31.

Referring now to FIGS. 29, 30 and 31, there is illustrated the connection of two wall panel assemblies to a connector post where the wall panel assemblies are not of equal height. To the right is a taller wall panel 550 and to the left is a shorter wall panel 552. As with the assembly of the wall panel system described in relation to FIGS. 19, 22, and 23, each wall panel is first connected to a connector post 554 using a plurality of vertical I-beam connectors, such as the vertical connectors 556, 558. As mentioned earlier, the I-beam connectors are received in one of the channels of the connector post and in the channels formed in the vertical frame members 560, 562 of the wall panel assemblies and thus are considered universal. There is a difference, however, in that more vertical I-beam connectors are used to connect the connector post and the taller wall panel 550 than are used to connect the connector post and the shorter wall panel 552.

Figure 22:
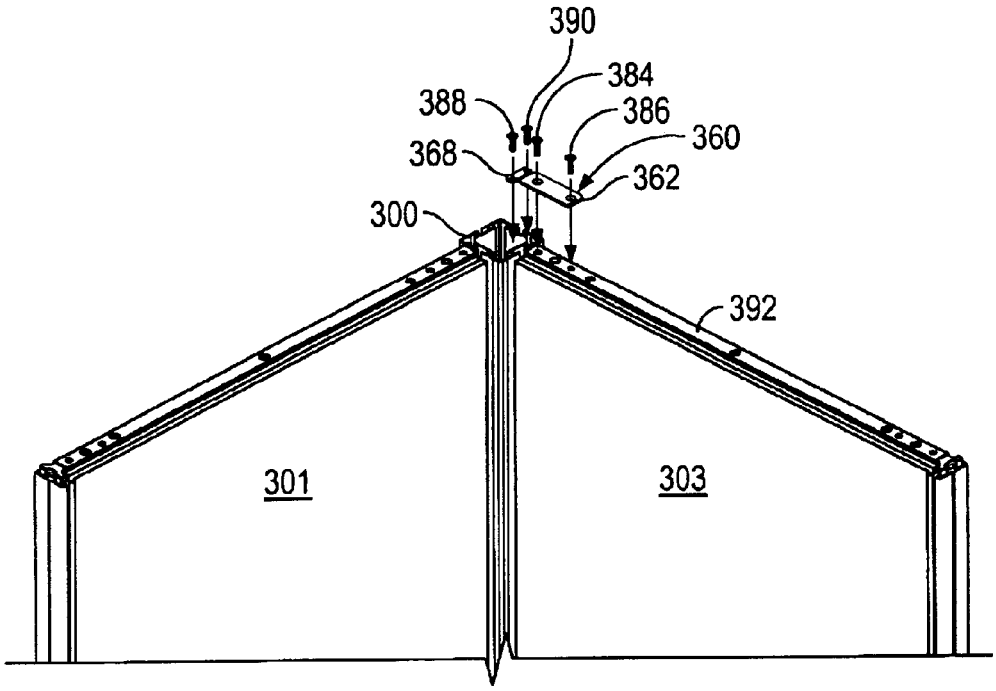
FIG. 22 is a exploded partial isometric view similar to that shown in FIG. 19 but illustrating the installation of a universal bracket to one of the wall panel assemblies and the universal connector post.
Figure 33:
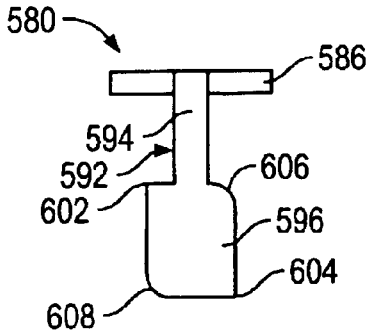
FIG. 33 is a front elevation view of the variable height bracket shown in FIGS. 31 and 32.
Figure 34:
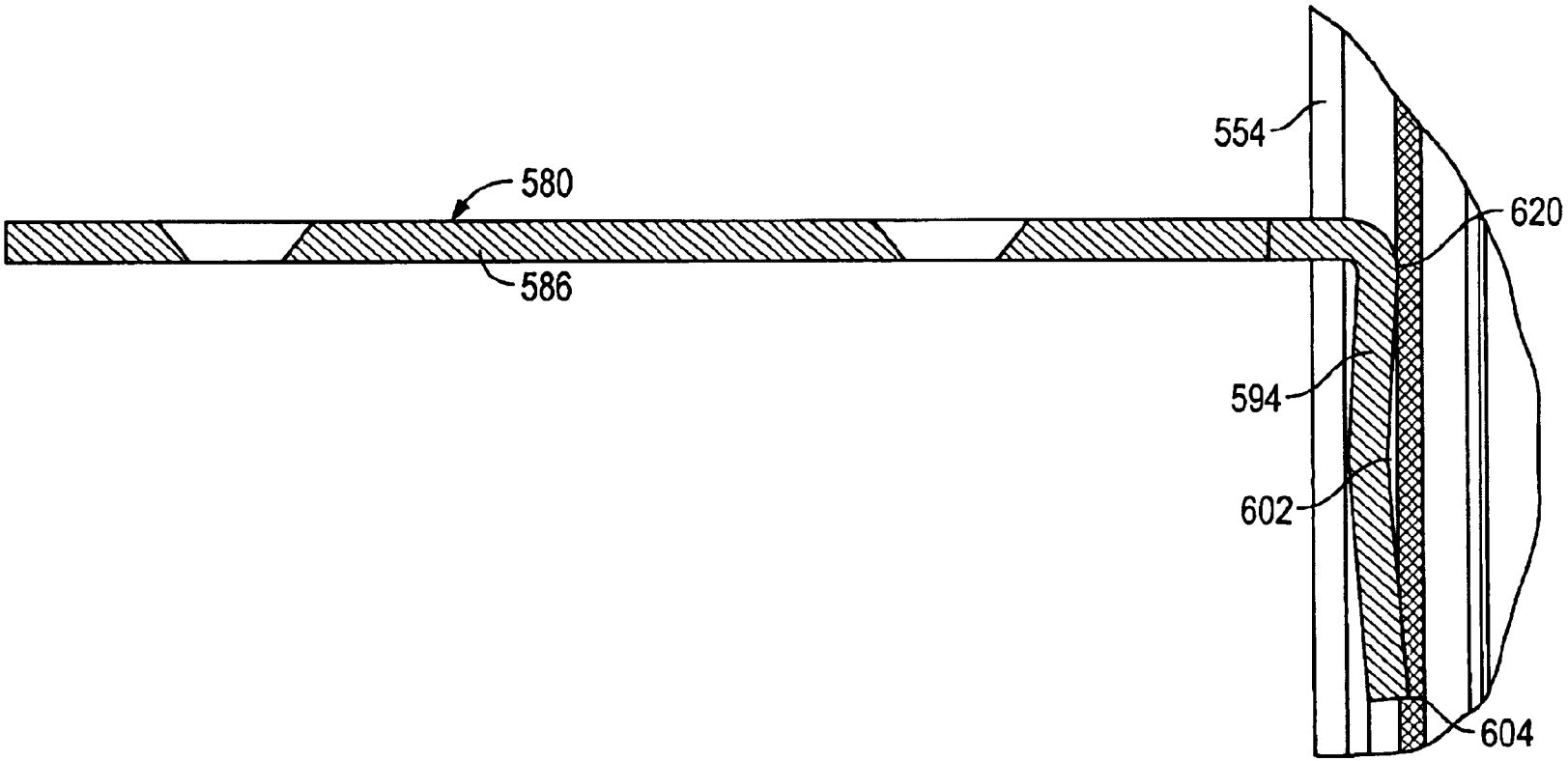
FIG. 34 is an enlarged sectional partially broken-away elevation view of a variable height bracket connected to a universal connector post.

After the I-beam connectors are in place, a universal bracket 570 is fastened by screws 572, 574, 576, 578 to both the taller wall panel 550 and to the connector post 554 as already described in regard to FIG. 22. A somewhat different bracket is used to connect the shorter wall panel 552 and the connector post 554. As shown in FIG. 30, a vertical height bracket 580 is used with just two fasteners 582, 584. The vertical height bracket 580 is shown more clearly in FIGS. 31–34 and includes a long end portion 586 with two fastener openings 588, 590 and a short end portion 592 in the form of a depending tab. It is noted that the depending tab portion is itself divided into a neck portion 594 and a rectangular head portion 596. While the short end tab portion is generally perpendicular to the long end portion, the neck portion and the head portion are not exactly linearly aligned, but are at an angle of approximately 170 degrees as shown by an arc 598. Further, the neck portion is not precisely at a right angle to the long end portion 586 but rather is bent to an angle of approximately 85 degrees as shown by an arc 600. There is a particular reason for this somewhat misaligned arrangement. The head portion 596, FIG. 33, has two pairs of diagonally opposite corners 602, 604 (upper left and lower right) and opposite corners 606, 608 (upper right and lower left). Each of the corner pair 606, 608 is rounded. Each of the corner pair 602, 604 is sharp.

When in assembly, the variable height bracket has the neck portion 594 received by a slot 610, FIG. 30, in the connector post 554. The variable height bracket is then lowered until the long end portion 586 makes contact with the top tube 612 of the shorter wall panel assembly 552. Thereafter the fasteners 582, 584 attach the variable height bracket 580 to the top tube 612. When the variable height bracket is attached by the fasteners 582, 584, to the shorter wall panel, the variable height bracket is able to pivot around an outer surface 620, FIG. 34, of the neck portion 594 so as to have the sharp corner pair 602, 604 of the head portion "bite into" or indent the metal of the connector post. This is easily accomplished because the variable height bracket is made of steel whereas the connector post is made of softer aluminum. The biting action creates a strong frictional engagement between the variable height bracket and the connector post as well as somewhat of an interference fit.

Figure 35:
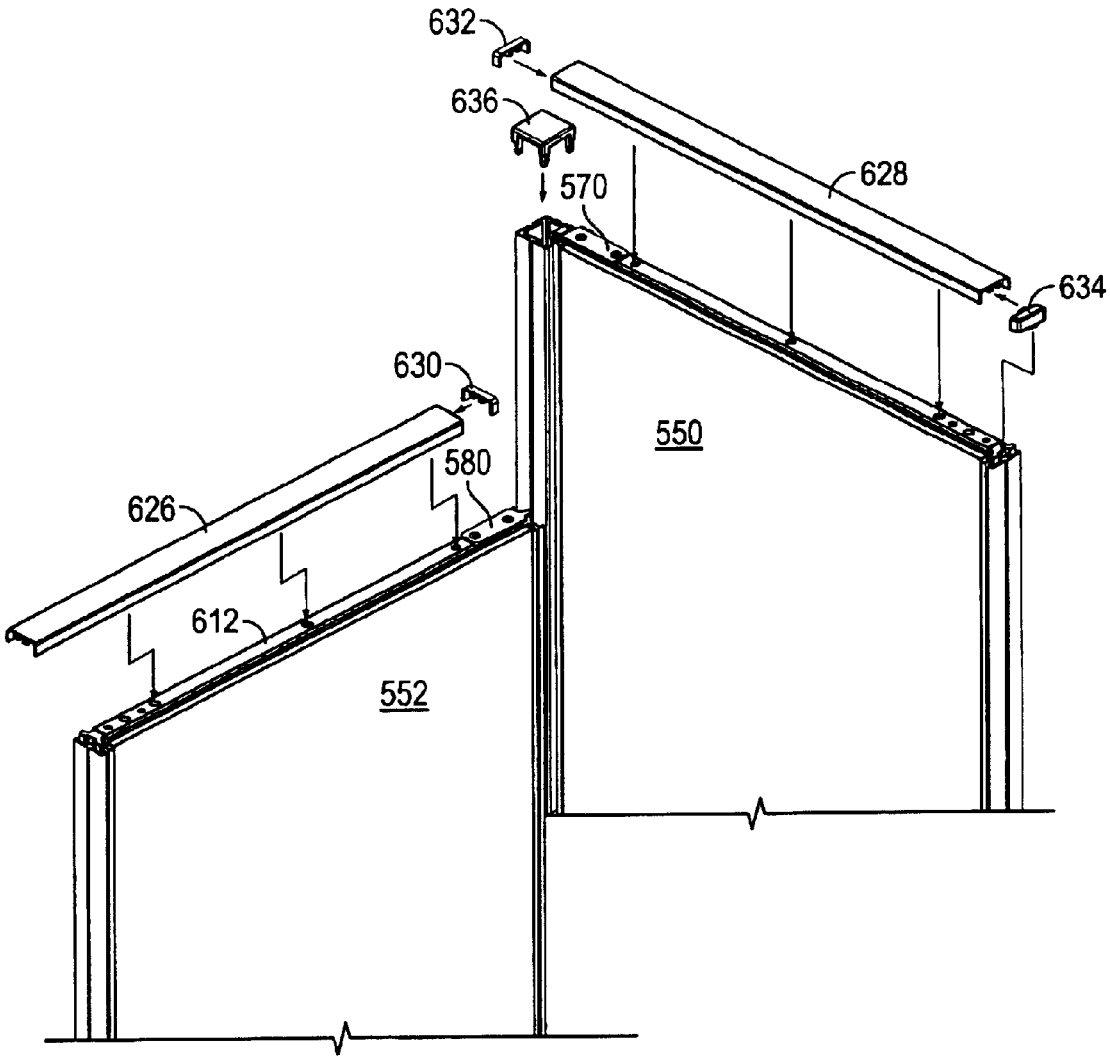
FIG. 35 is an exploded partial isometric view similar to FIGS. 29 and 30 illustrating the installation of top caps, transition caps, an end cap and a corner cap.

Once all of the brackets are in place, the connected wall panel assemblies are finished as explained above. Top caps 626, 628, FIG. 35, are connected to each of the wall panels as are transition caps 630, 632 and end caps, only one which is shown, the end cap 634. A corner cap 636 is also installed though it differs from the corner cap 410 of FIG. 23 in that only one side wall is partially removed to accommodate the universal bracket 570. There is no need to accommodate the variable height bracket 580 as it is at a lower elevation.

Figure 36:
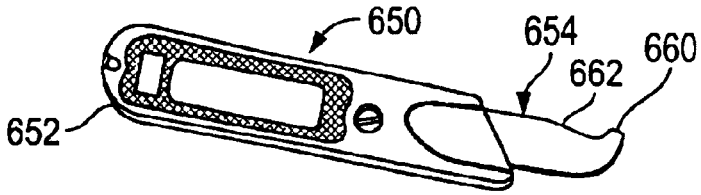
FIG. 36 is a plan view of a removal tool for use in disassembling a wall panel system.
Figure 37:
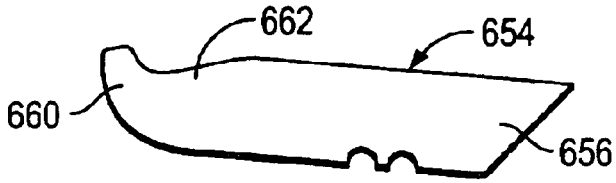
FIG. 37 is an enlarged plan view of a blade of the tool shown in FIG. 36.
Figure 38:
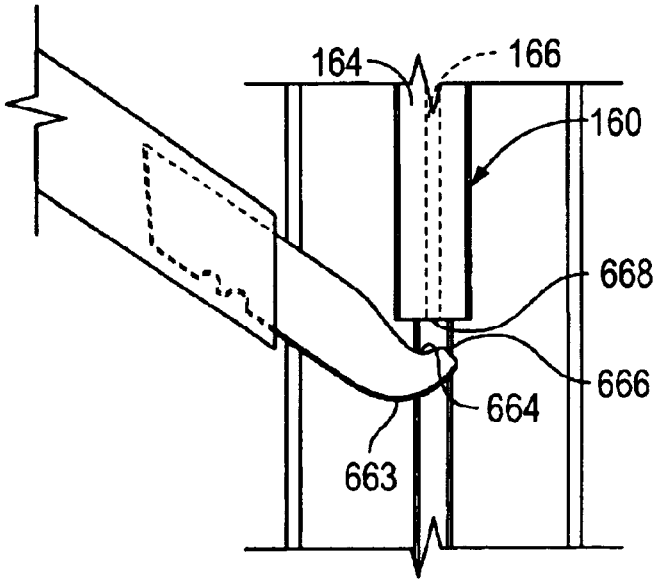
FIG. 38 is a diagrammatic view illustrating the use of the tool shown in FIG. 36 in removing a vertically disposed I-beam connector.

Referring now to FIGS. 36, 37 and 38, there is illustrated a removal tool 650 to be used with the wall panel system described above. The tool includes a handle 652 similar to the handle of a box opener and a uniquely shaped flat portion or blade 654. The blade includes a mounting portion 656, a hook portion 660 and a mid-portion 662. The mounting portion 656 is received by said handle 652 and is connected in traditional fashion. The blade includes a curved edge 663 beneath the mid-portion, a flat edge 664 and a slanted edge 666. The hook portion 660 extends a distance beyond the handle so as to pass beyond half the width of a connector post or of a side frame member. Stated another way, the hook portion extends a distance beyond one-half the width of the connector post and the side frame member so that it is beyond the middle portion 166, FIG. 10, of the I-beam shaped connector 160. When this occurs, the flat edge 664 of the blade is aligned with a bottom surface 668 of the middle portion of the I-beam shaped connector. The slanted edge 666 is beyond the middle portion of the connector. When an operator applies an upward force on the handle, the force is transmitted to the hook portion of the blade and in particular to the flat edge 664 of the blade. This flat edge abuts and applies the force to the bottom surface 668 of the I-beam connector thereby allowing removal so as to disconnect a wall panel assembly from a connector post or from another wall panel assembly. This tool aids in the disassembly of the wall panel system thereby enhancing system versatility to be resited and/or reconfigured. The tool also is efficient and effective and reduces the time needed for disassembly.

The above specification describes in detail a preferred embodiment of the present invention. Other examples, embodiments, modifications and variations will, under both the literal claim language and the doctrine of equivalents, come within the scope of the invention defined by the appended claims. For example, minor changes in any or all of the elements of the wall panel system are considered equivalent and will also come within the literal language of the claims. Still other alternatives will also be equivalent as will many new technologies. There is no desire or intention here to limit in any way the application of the doctrine of equivalents nor to limit or restrict the scope of the claims.

What is claimed is:

1. A wall panel system comprising:

a wall panel assembly, said wall panel assembly including two vertically oriented side frame members, a horizontally disposed top frame member being connected to said side frame members, and a horizontally disposed top cap connected to said top frame member;

an elongated vertically disposed universal connector post;

an elongated connector connected to said connector post and to one of said side frame members;

a bracket attached to said top frame member and to said connector post, said bracket having a first end portion including two openings for receiving fasteners to connect to said top frame member and a second end portion to be connected to said connector post;

a corner cap engaging and covering a to end of said universal connector post;

a horizontally disposed bottom frame member connected to said side frame members; and a pair of panel supports connected to said bottom frame member; and wherein said elongated connector has an I-beam shaped section; and said connector post includes four walls, each with a central slot, four rectangular channels, and four pairs of circular channels.

2. The wall panel system of claim 1 wherein:

each of said bracket openings align with an opening in said top frame member and each pair of aligned openings adapted to receive the same fastener;

said second end portion includes two fastener receiving openings, said second end portion openings being aligned with a pair of said circular channels of said connector post; and said two openings of said first end portion of said bracket form an alignment in a direction generally perpendicular to an alignment of said two openings of said second end portion.

3. The wall panel system of claim 2 wherein:

said two openings of said first end portion of said bracket are at a higher elevation than said two openings of said second end portion.

4. The wall panel system of claim 3 wherein:

said two openings of said first end portion lying in a plane which is parallel to a plane formed by said two openings of said second end portion.

5. The wall panel system of claim 4 including:

a neck portion disposed between said first and said second end portions of said bracket.

6. The wall panel system of claim 2 including:

a second bracket adapted to be connected to said connector post and to a shorter wall panel assembly, said second bracket having a first end portion with two openings, each opening for receiving a fastener that is also received by said shorter wall panel assembly; and wherein said second bracket includes a second end portion in the form of a depending tab; and said depending tab includes a first portion and a second portion, said first portion of said tab depends at an angle of about 85 degrees from said first end portion of said second bracket and said second portion of said tab makes an angle of about 170 degrees with said first portion of said tab.

7. The wall panel system of claim 6 wherein:

said first portion of said tab defines a neck and said second portion of said tab defines a head.

8. The wall panel system of claim 7 wherein:

said head is generally rectangular in shape having a first pair of rounded diagonal corners and a second pair of sharp diagonal corners.

9. The wall panel system of claim 1 wherein:

said corner cap includes a top wall, four depending side walls connected to said top wall, four legs extending away from said top wall, and scores formed in each side wall, a vertical score along an intersection of each of said side walls and respective legs and a horizontal score along an intersection of each of said side walls with said top wall whereby one or more side walls may be partially removed before connecting said corner cap to said wall panel system.

10. The wall panel system of claim 1 wherein:

each of said top frame member and said bottom frame member comprises a tube to which fork inserts are connected, each fork insert having two prongs engaging with one of said side frame members.

11. The wall panel system of claim 1 wherein:

said wall panel assembly also includes an interior core, an inner frame positioned around said core, a hardboard layer connected to said inner frame, a fibreglass layer positioned over said hardboard layer, a fabric layer placed over said fibreglass layer, said side frame members are made of metal and are connected to said inner frame, said top frame member is made of metal and is connected to said inner frame, said top frame member including metal fork inserts mounted to a tube, said fork inserts engaging said side frame members; and including a bottom frame member;

a metal panel support mounted to said bottom frame member;

a base rail channel mounted to said bottom frame member;

a base rail cover mounted to said base rail channel; and an adjustable guide mounted to said panel support.

12. The wall panel system of claim 11 wherein:

each of said side frame members includes two spaced apart enclosed channels separated by a slotted channel.

13. The wall panel system of claim 12 wherein:

said bottom frame member includes a metal tube.

14. The wall panel system of claim 1 including:

a removal tool, said tool having a handle and a flat element mounted to said handle, said flat element having a mounting portion, a hook portion and a mid-portion, said hook portion for extending beyond a middle portion of said elongated connector.

15. A wall panel system comprising:

a wall panel assembly, said wall panel assembly including two vertically oriented side frame members, a horizontally disposed top frame member being connected to said side frame members, and a horizontally disposed top cap connected to said top frame member;

an elongated vertically disposed universal connector post;

an elongated connector connected to said connector post and to one of said side frame members;

a bracket attached to said top frame member and to said connector post, said bracket having a first end portion including two openings for receiving fasteners to connect to said top frame member and a second end portion to be connected to said connector post; and a corner cap engaging and covering a top end of said universal connector post; and wherein said corner cap includes a top wall, four depending side walls connected to said top wall, four legs extending away from said top wall, and scores formed in each side wall, a vertical score along an intersection of each of said side walls and respective legs and a horizontal score along an intersection of each of said side walls with said top wall whereby one or more side walls may be partially removed before connecting said corner cap to said wall panel system.

16. A method for assembling a wall panel system comprising the steps of:

providing a universal connector post;

providing at least two wall panel assemblies;

providing vertically disposed I-beam shaped connectors;

placing said I-beam shaped connectors into channels of selected side frame members of said wall assemblies and into selected channels formed in said universal connector post;

providing brackets;

fastening said brackets to said wall panel assemblies and to said universal connector post;

fastening top caps to said wall panel assemblies;

providing a universal corner cap;

removing one or more side wall portions from said corner cap to accommodate said brackets; and engaging said corner cap with a top end of said universal connector post.

17. The method for assembling a wall panel system of claim 16 including the step of:

scoring said universal corner cap along side wall portions thereof.

18. The method for assembling a wall panel system of claim 16 including the step of:

scoring said corner cap at intersections of said side wall portions and a top wall of said corner cap.

19. The method for assembling a wall panel system of claim 16 including the steps of:

providing at least one wall panel assembly that is shorter than another wall panel assembly;

placing a plurality of I-beam shaped connectors into a channel of a selected side frame member of a taller wall panel assembly and into a connector post channel adjacent said taller wall panel assembly;

placing fewer I-beam shaped connectors into a channel of a selected side frame member of said shorter wall panel assembly than have been placed in said selected side frame member of said taller wall panel assembly and into a connector post channel adjacent said shorter wall panel assembly;

providing a first bracket having fastener openings in a first end portion to receive fasteners to connect to said taller wall panel assembly and fastener openings in a second end portion to receive fasteners to connect to said connector post;

providing a second bracket having fastener openings in a first end portion to receive fasteners to connect to said shorter wall panel assembly and a depending tab to connect to said connector post;

fastening said first bracket to said taller wall panel assembly and to said connector post;

sliding said second bracket into said corner post channel adjacent said shorter wall panel assembly; and fastening said second bracket to said shorter wall panel assembly which also engages said tab to said connector post.

20. The method for assembling a wall panel system of claim 19 including the step of:

scoring said universal corner cap along said side wall portions thereof.

21. The method for assembling a wall panel system of claim 20 including the step of:

scoring said corner cap at intersections of said side wall portions and a top wall of said corner cap.

* * * * *

UNITED STATES PATENT AND TRADEMARK OFFICE

CERTIFICATE OF CORRECTION

PATENT NO. : 6,964,138 B2
APPLICATION NO. : 10/145338
DATED : November 15, 2005
INVENTOR(S) : Mark Carroll et al.

It is certified that error appears in the above-identified patent and that said Letters Patent is hereby corrected as shown below:

Col.10, line 48, after "covering a" please delete "to" and insert --top--.

Col. 11, line 38, after "claim" please delete "1" and insert --2--.

Signed and Sealed this

Thirteenth Day of February, 2007

JON W. DUDAS
*Director of the United States Patent and Trademark Office*